US006622622B2

(12) United States Patent
Lee et al.

(10) Patent No.: US 6,622,622 B2
(45) Date of Patent: Sep. 23, 2003

(54) ADJUSTABLE PAPER GUIDE DEVICE

(75) Inventors: Yoon-Jun Lee, Suwon-si (KR); Jang-Hwan Kim, Suwon-si (KR)

(73) Assignee: Korea Printing Systems Co., Ltd., Kyunggi-Do (KR)

( * ) Notice: Subject to any disclaimer, the term of this patent is extended or adjusted under 35 U.S.C. 154(b) by 0 days.

(21) Appl. No.: 10/132,576

(22) Filed: Apr. 26, 2002

(65) Prior Publication Data

US 2003/0159603 A1 Aug. 28, 2003

(30) Foreign Application Priority Data

Feb. 27, 2002 (KR) ..... 2002-10661

(51) Int. Cl.[7] ..... B41J 15/04; B65H 23/00
(52) U.S. Cl. ..... 101/228; 242/615.1; 400/61.9
(58) Field of Search ..... 101/228; 400/613, 400/619, 630, 693, 579; 242/615, 615.1, 566

(56) References Cited

U.S. PATENT DOCUMENTS 2,578,088 A * 12/1951 Pierce ..... 400/703
4,750,660 A * 6/1988 Kamimura ..... 242/615.3
5,486,259 A * 1/1996 Goodwin et al. ..... 156/384
5,813,343 A * 9/1998 Harb ..... 101/407.1
6,158,342 A * 12/2000 Moore ..... 101/407.1
6,302,604 B1 * 10/2001 Bryant et al. ..... 400/619
6,431,492 B1 * 8/2002 Chillscyzn ..... 242/577
6,503,008 B2 * 1/2003 Zevin et al. ..... 400/613

* cited by examiner

*Primary Examiner*—Andrew H. Hirshfeld
*Assistant Examiner*—Leo T. Hinze
(74) *Attorney, Agent, or Firm*—Morgan, Lewis & Bockius LLP

(57) ABSTRACT

Disclosed is a paper guide device suitable for a label printer. The paper guide device comprises left and right guide members defined, on one side surfaces thereof facing each other, with guide grooves which receive and guide both widthwise edges of paper, and formed, on respective rear and front surfaces thereof, with flat geared portions; left and right gear bands formed, on respective front and rear surfaces thereof, with rack gears which are respectively meshed with the flat geared portions of the left and right guide members; a pinion gear positioned between the left and right-gear bands and meshed with the rack gears of them; and an adjustment knob slidably installed on a printer body and connected to one end of the right gear band.

4 Claims, 5 Drawing Sheets

ADJUSTABLE PAPER GUIDE DEVICE

BACKGROUND OF THE INVENTION

1. Field of the Invention

The present invention relates to a paper guide device used upon feeding paper from its roll accommodated in a label printer, and more particularly, the present invention relates to a paper guide device which is modified in its construction to allow a pair of guide members for guiding feeding of paper at both widthwise edges of the paper to be adjusted in their positions in an easy manner, thereby rendering user convenience.

2. Description of the Related Art

Generally, a label printer is used to print a trade name, a price, an expiration date, etc. on a label sheet and thereby allow the printed label sheet to be affixed to a product. A number of label sheets are peelably attached to paper which is wound in the form of a roll, in a manner such that they are separated one from another by a certain distance. Depending upon a use, the paper has a, width of about 1 to 4 inches.

The paper which is wound in the form of a roll is accommodated in a body of the label printer. The paper roll is rotatably supported by a holding unit which extends through a center hole of the paper roll. Consequently, the paper can be continuously paid out from the roll as a printing work proceeds. The paper is fed between a printing roller and a printing head which constitute a printing section, by a feeding roller, to allow the label sheets to be properly printed.

Referring to FIG. 1, there is illustrated a label printer which employs a conventional paper guide device. The label printer designated by the reference numeral 10 has a printer body 3 and a cover 1 which is hingedly coupled to one end of the printer body 3. A printing head 2 is installed on a lower surface of a distal end of the cover 1. An accommodating section 4 for accommodating paper P wound in the form of a roll is defined in the printer body 3. The paper guide device for guiding both widthwise edges of the paper P is disposed in front of the accommodating section 4. Further, a printing roller 5 is arranged in front of the paper guide device to be brought into contact with the printing head 2. The printing roller 5 functions to support a label sheet attached to the paper, upon printing.

As shown in FIG. 2, the conventional paper guide device employed in the label printer 10 includes left and right guide members 6 and 7, a shaft element 8, and an adjustment knob 9. A pair of, slots 3*a* and 3*b* are defined through an upper wall of the printer body. 3 in a manner such that they extend in a widthwise direction of the printer body 3. The left and right guide members 6 and 7 are respectively defined, on one side surfaces facing each other, with guide grooves 6*a* and 7*a* in which both widthwise edges of the paper P are received and guided. The left and, right guide members 6 and 7 are further defined, adjacent to lower ends thereof, with threaded holes 6*b* and 7*b*, respectively. The shaft element 8 is rotatably supported by the printer body 3 directly below the pair of slots 3*a* and 3*b*. A right-hand threaded portion 8*a* and a left-hand threaded portion 8*b* are formed on a circumferential outer surface of the shaft element 8 in a manner such that they are separated from each other by a middle portion which is not threaded and they threadedly pass through the threaded holes 6*b* and 7*b* of the left and right guide members 6 and 7. The adjustment knob 9 is coupled to one end of the shaft element 8 and supported by a slide wall of the printer body 3, so that the shaft element 8 can be rotated upon manipulating the adjustment knob 9.

A pair of enlarged openings 3-1 and 3-2 are defined at inner ends of the pair of slots 3*a* and 3*b*, which inner ends neighbor to each other, in a manner such that substantially lower halves of the left and right guide members 6 and 7 are inserted through the pair of enlarged openings 3-1, and 3-2, respectively.

The middle portion of the shaft element 8, which middle portion is not threaded, passes through a support leg portion 3-3 which is integrally formed on an inner surface of the upper wall of the printer body 3, to be supported thereby. As can be readily seen from FIG. 2, the adjustment knob 9 passes through the side wall of the printer body 3 to be coupled to the one end of the shaft element 8.

It is to be readily understood that the threaded holes 6*b* and 7*b* of the left and right guide members 6 and 7 are right-hand threaded and left-hand threaded to be coupled with the right-hand threaded portion 8*a* and the left-hand threaded portion 8*b* of the shaft element 8, respectively.

Both widthwise edges of the paper P which is accommodated in the accommodating section 4 defined in the printer body 3 are guided as described below by the paper guide device constructed as mentioned above.

Referring to FIGS. 2 and 3, the lower halves of the left and right guide members 6 and 7 are respectively inserted through the pair of enlarged openings 3-1 and 3-2 defined at the inner ends of the pair of slots 3*a* and 3*b* which are defined through the printer body 3. The right-hand threaded portion 8*a* and the left-hand threaded portion 8*b* of the shaft element 8, which is rotatably supported by the printer body 3 directly below the pair of slots 3*a* and 3*b*, threadedly pass through the threaded holes 6*b* and 7*b* of the left and right guide members 6 and 7.

That is to say, since the right-hand threaded portion 8*a* and the left-hand threaded portion 8*b* of the shaft element 8 threadedly pass through the right-hand threaded hole 6*b* and the left-hand threaded hole 7*b* of the left and right guide members 6 and 7, respectively, if the shaft element 8 is rotated, the left and right guide members 6 and 7 can be moved along the pair of slots 3*a* and 3*b* in a horizontal direction in such a manner that a spacing measured between the left and right guide members 6 and 7 can be shortened or lengthened. The number of revolutions of the shaft element 8 corresponds to that of the adjustment knob 9 which is coupled to the one end of the shaft element 8 and supported by the side wall of the printer body 3.

As the case may be, it may be necessary to adjust a spacing between the left and right guide members 6 and 7 in conformity with a width of the paper P. Under this situation, by paying out the paper P from its roll rotatably supported by a center shaft (not shown) serving as a holding unit and by rotating in one direction the adjustment knob 9, that is, the shaft element 8, the widthwise edges of the paper P can be received and guided in the guide grooves 6*a* and 7*a* of the left and right guide members 6 and 7, and thereby, the paper P can be fed along a straight path to allow the label sheet to be properly printed.

When the paper, roll is to be changed with new one, the adjustment knob 9, which is positioned outward of and supported by the side wall of the printer body 3, is grasped and rotated in the other direction to free the widthwise edges of the paper P from the guide grooves 6*a* and 7*a* of the left and right guide members 6 and 7. At this time, the conventional paper guide device suffers from defects in that, since the adjustment knob 9 should be rotated in the other direction through at least 3 revolutions in order to appropriately and threadedly move the left and right guide members 6 and 7 on the right-hand threaded portion 8*a* and the left-hand threaded portion 8*b* of the shaft element 8 and rotated again in the reverse direction through at least 3 revolutions upon completion of paper roll changing in order to receive both widthwise edges of the paper P in the guide grooves 6*a* and 7*a* of the left and right guide members 6 and 7, user bothersomeness is caused and a paper roll changing time is extended.

SUMMARY OF THE INVENTION

Accordingly, the present invention has been made in an effort to solve the-problems occurring in the related art, and an object of the present invention is to provide a paper guide device used upon feeding paper from its roll accommodated in a label printer, which is modified in its construction to allow a pair of guide members for guiding feeding of the paper at both widthwise edges of the paper to be adjusted in their positions in an easy manner, thereby rendering user convenience.

In order to achieve the above object, according to the present invention, there is provided a paper guide device suitable for a label printer, comprising: left and right guide members defined, on one side surfaces thereof facing each other, with guide grooves which receive and guide both widthwise edges of paper, and formed, on respective rear and front surfaces thereof, with flat geared portions; left and right gear bands formed, on respective front and rear surfaces thereof, with rack gears which are respectively meshed with the flat geared portions of the left and right guide members; a pinion gear positioned between the left and right gear bands and meshed with the rack gears of them; and an adjustment knob slidably installed on a printer body and connected to one end of the right gear band.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
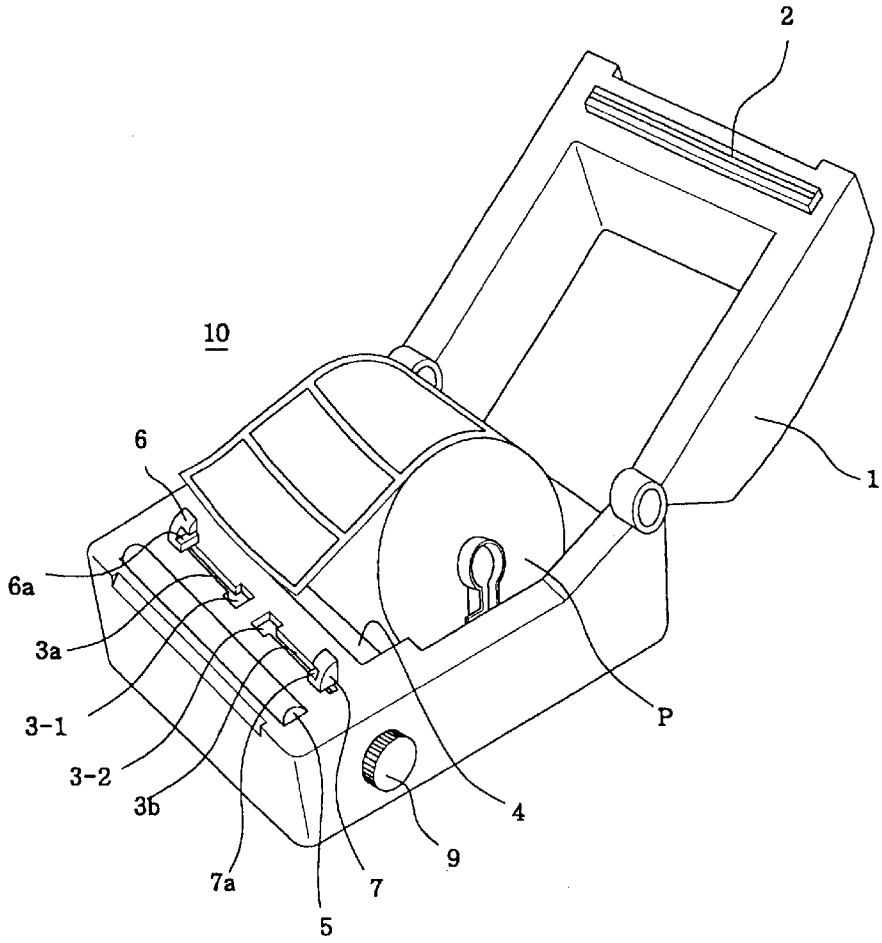
Fig. 1 RELATED ART
FIG. 1 is a perspective view illustrating a label printer which employs a conventional paper guide device.
Figure 2:
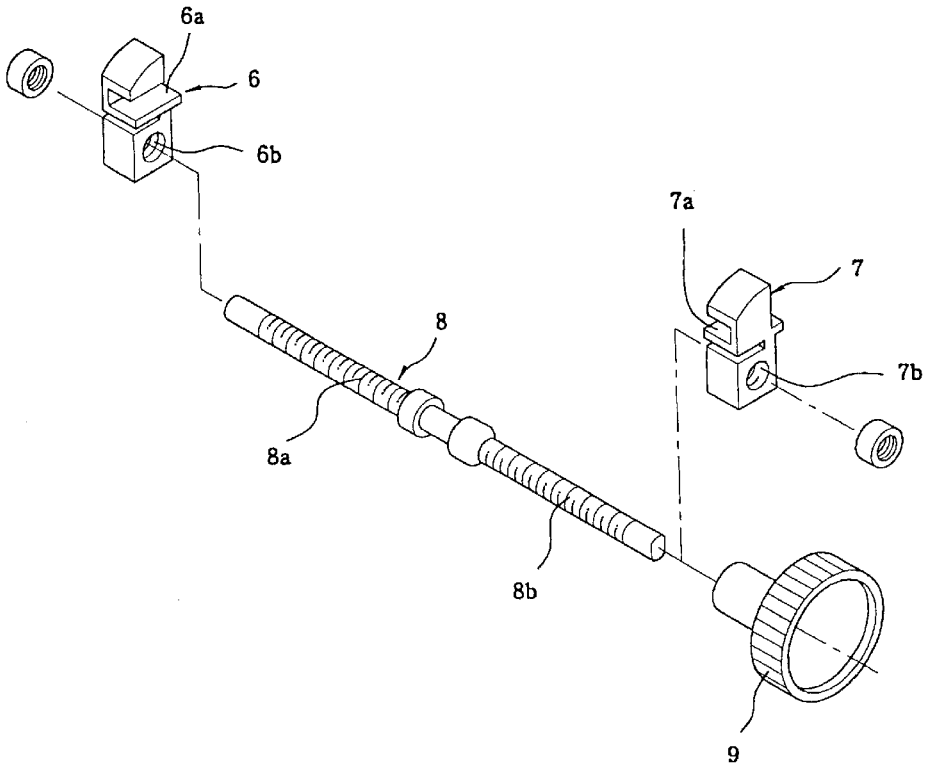
Fig. 2 RELATED ART
FIG. 2 is an exploded perspective view independently illustrating the conventional paper guide device.
Figure 3:
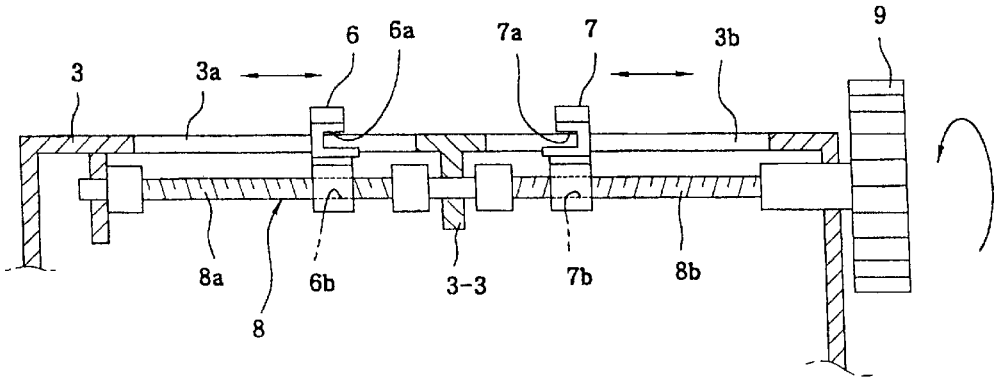
Fig. 3 RELATED ART
FIG. 3 is a front longitudinal sectional view illustrating an in-use status of the paper guide device of FIG. 2.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 4:
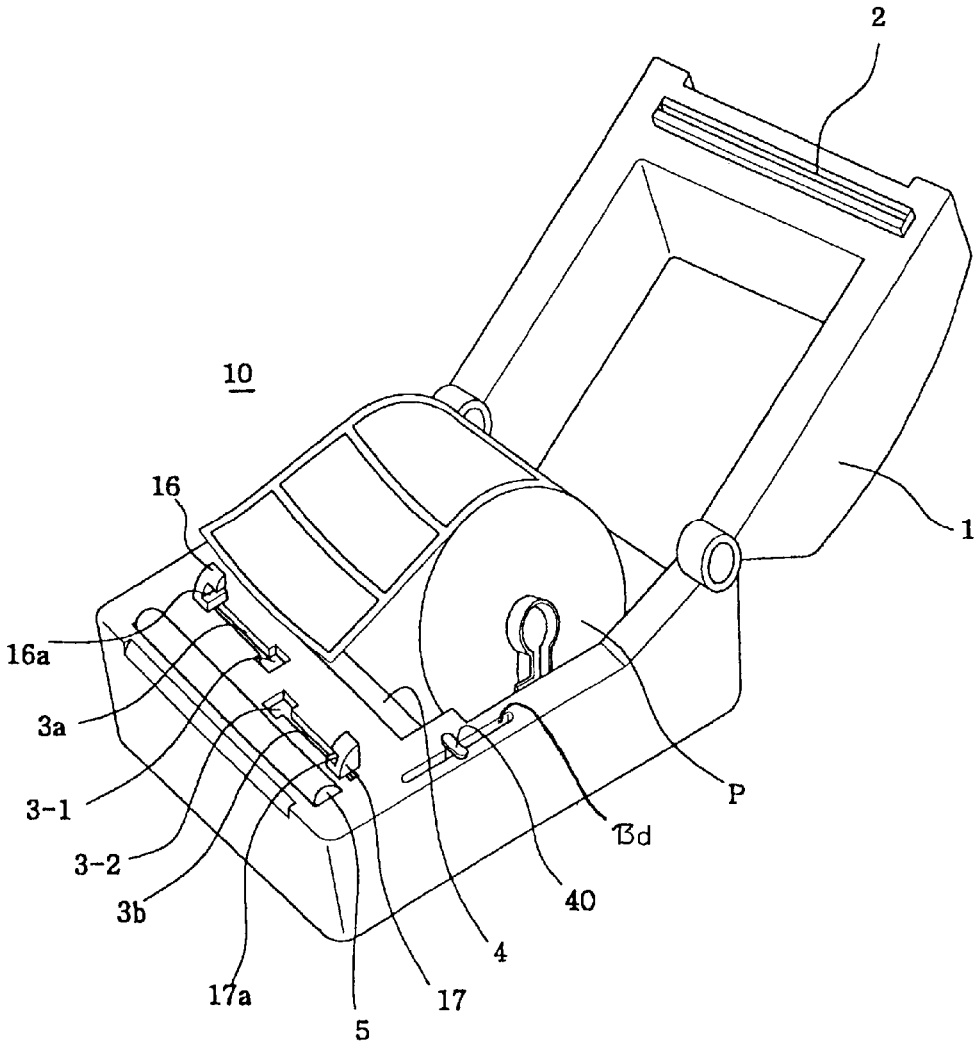
FIG. 4 is a perspective view illustrating a label printer which employs a paper guide device in accordance with an embodiment of the present invention.

Referring to FIG. 4, there is illustrated a label printer which employs a paper guide device in accordance with an embodiment of the present invention. The label printer designated by the reference numeral 10 has a printer body 3 and a cover 1 which is hingedly coupled to one end of the printer body 3. A printing head 2 is installed on a lower surface of a distal end of the cover 1. An accommodating section 4 for accommodating paper P wound in the form of a roll is defined in the printer body 3. The paper guide device for guiding both widthwise edges of the paper P is disposed in front of the accommodating section 4. Further, a printing roller 5 is arranged in front of the paper guide device to be brought into contact with the printing head 2. The printing roller 5 functions to support a label sheet attached to the paper, upon printing.

Figure 5:
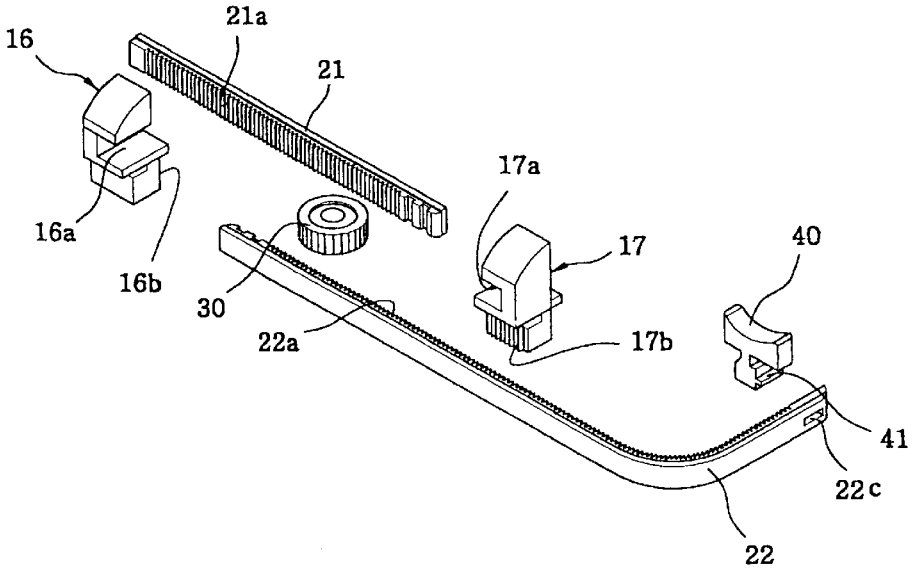
FIG. 5 is an exploded perspective view independently illustrating the paper guide device according to the present invention.
Figure 6:
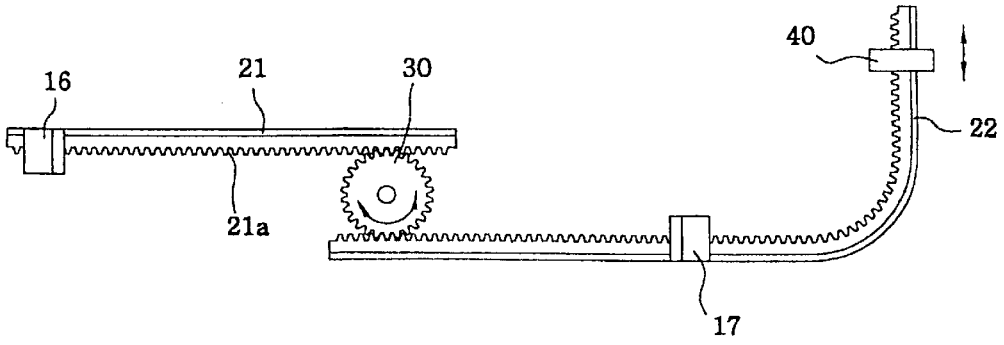
FIG. 6 is a top transverse sectional view illustrating an assembled status of the paper guide device according to the present invention.
Figure 7:
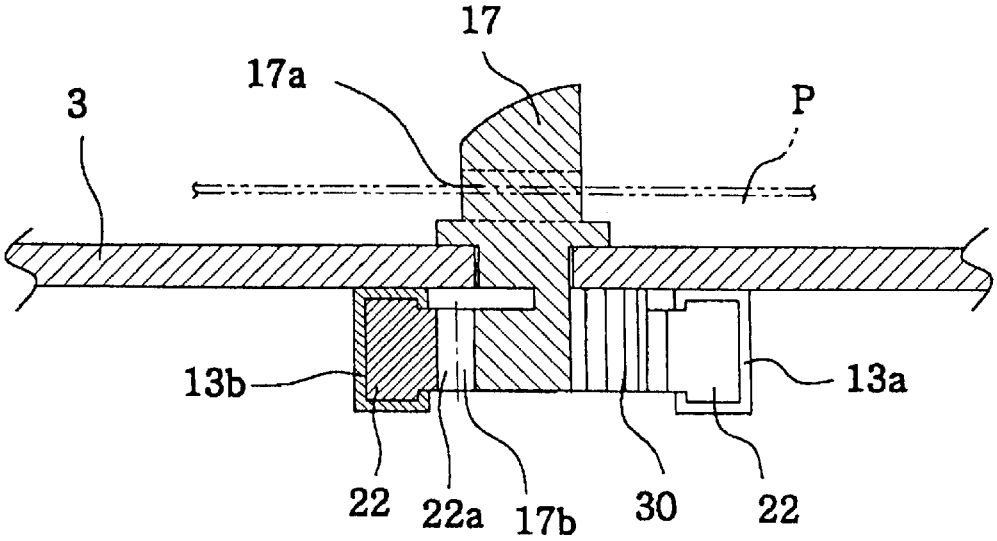
FIGS. 7 and 8 are side longitudinal sectional views each illustrating an in-use status of the paper guide device according to the present invention.
Figure 8:
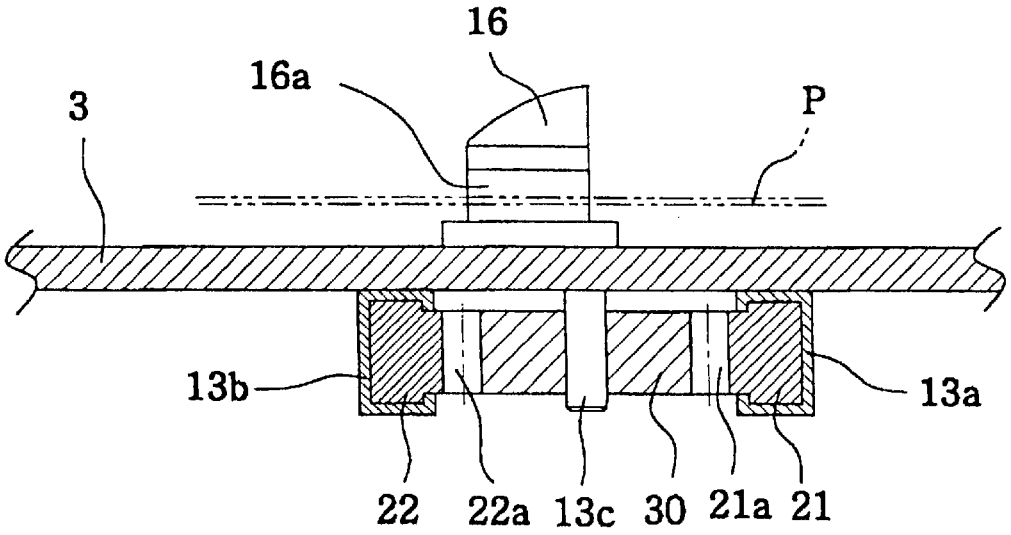

As shown in FIG. 5, the paper guide device according to the present invention comprises left and right guide members 16 and 17, left and right gear bands 21 and 22, a pinion gear 30, and an adjustment knob 40. The left and right guide members 16 and 17 are defined, on one side surfaces thereof facing each other, with guide grooves 16*a* and 17*a* which receive and guide both widthwise edges of the paper P, and are formed, on respective rear and front surfaces thereof, with flat geared portions 16*b* and 17*b*. The left and right gear bands 21 and 22 are formed, on respective front and rear surfaces thereof, with rack gears 21*a* and 22*a* which are respectively meshed with the flat geared portions 16*b* and 17*b* of the left and right guide members 16 and 17. The pinion gear 30 is positioned between the left and right gear bands 21 and 22 and is meshed with the rack gears 21*a* and 22*a* of the left and right gear bands 21 and 22. The adjustment knob 40 is slidably installed on the printer body 3 and is connected to one end of the right gear band 22.

The left and right gear bands 21 and 22 are made of synthetic resin having a predetermined flexibility. A fitting hole 22*c* is defined at the one end of the right gear band 22, and a projection 41 which is fitted into the fitting hole 22*c* is formed adjacent to a lower end of the adjustment knob 40.

A pair of guide rails 13*a* and 13*b* for guiding the left and right gear bands 21 and 22 are secured to an inner surface of an upper wall of the printer body 3. A rotation shaft 13*c* for rotatably supporting the pinion gear 30 is secured to the inner surface of the upper wall of the printer body 3 between the pair of guide rails 13*a* and 13*b*. A pair of slots 3*a* and 3*b* for allowing the left and right guide members 16 and 17 to be moved therealong are defined through the upper wall of the printer body 3 to extend in a widthwise direction of the printer body 3. An adjustment slot 13*d* for allowing the adjustment knob 40 to be moved therealong is defined through the upper wall of the printer body 3 to extend in a lengthwise direction of the printer body 3.

That is to say, the adjustment slot 13*d* is defined through the upper wall of the printer body 3 in such a way as to allow the adjustment knob 40 to be moved forward and rearward therealong. The guide rail 13*b* for guiding the right gear band 22 extends in the widthwise direction of the printer body 3 through a predetermined distance and then, is curved through a right angle to extend in the lengthwise direction of the printer body 3 toward the adjustment slot 13*d*. The guide rail 13*a* for guiding:the left gear band 21 extends only in the widthwise direction of the printer body 3.

The unexplained reference numerals 3-1 and 3-2 designate a pair of enlarged openings defined at inner ends of the pair of slots 3*a* and 3*b*.

Hereafter, operation of the paper guide device for a label printer according to the present invention, constructed as mentioned above, will be described.

Lower halves of the left and right guide members 16 and 17 are inserted through the enlarged openings 3-1 and 3-2 of the slots 3*a* and 3*b* defined through the upper wall of the printer body 3. The rack gears 21*a* and 22*a* of the left and right gear bands 21 and 22, which are respectively assembled to the pair of guide, rails 13*a* and 13*b* secured to the inner surface of the upper wall of the printer body 3, are meshed with the flat geared portions 16*b* and 17*b* of the left and right guide members 16 and 17, respectively.

The meshing of the rack gears 21*a* and 22*a* of the left and right gear bands 21 and 22 with the flat geared portions 16*b* and 17*b* of the left and right guide members 16 and 17 can be effected by lightly pushing rearward and pulling forward the adjustment knob 40 inserted through the adjustment slot 13*d*, while inserting the lower halves of the left and right guide members 16 and 17 through the enlarged openings 3-1 and 3-2 of the slots 3*a* and 3*b*.

Here, due to the fact that the rack gears 21*a* and 22*a* of the left and right gear bands 21 and 22 are meshed with the pinion gear 30 which are rotatably supported by the rotation shaft 13*c* secured to the inner surface of the upper wall of the printer body 3 and that-the flat geared portions 16*b* and 17*b* of the left and right guide members 16 and 17 are respectively meshed with the rack gears 21*a* and 22*a* of the left and right gear bands 21 and 22, the left and right guide members 16 and 17 are operationally connected with each other.

The left and right gear bands 21 and 22 can be moved along the pair of guide rails 13*a* and 13*b*. Specifically, since the right gear,band 22 is made of synthetic resin having the predetermined flexibility and is curved through the right angle to extend in the lengthwise direction of the printer body 3 toward the adjustment knob 40, the right gear band 22 can be-smoothly moved along the corresponding guide rail 13*b*, and thereby a spacing measured between the left and right guide members 16 and 17 can be adjusted.

As a consequence, by sliding the adjustment knob 40 along the adjustment slot 13*d*, a spacing-measured between the left and right guide members 16 and 17 can be shortened or lengthened, and in this way, the widthwise edges of the paper P can be guided in a state wherein they are respectively received in the guide grooves 16*a* and 17*a* of the left and right guide members 16 and 17.

When it is necessary to change the paper roll with new one, as the adjustment knob 40 is pulled forward, a spacing between the left and right guide members 16 and 17, which guide the widthwise edges of the paper P, is lengthened to permit paper roll changing work to be performed. At this time, because the adjustment knob 40 can be moved along the adjustment slot 13*d* by being manipulated in a one-touch manner, user convenience is rendered in that an adjustment knob manipulation time can be decreased when compared to the conventional paper guide device in which the adjustment knob should be rotated through at least 3 revolutions in one direction.

As apparent from the above description, in the paper guide device according to the present invention, which is used for guiding feeding of both widthwise edges of paper paid out from its roll accommodated in a label printer, left and right gear bands are respectively formed with rack gears, and a pinion gear is positioned between and meshed with the rack gears of the left and right gear bands. Therefore, advantages are provided in that, since a spacing measured between left and right guide members for receiving and thereby guiding the widthwise edges of the paper can be easily adjusted by pushing or pulling, in a one-touch manner, a sliding type adjustment knob installed on a printer body, user convenience is rendered.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A paper guide device suitable for a label printer, comprising:

left and right guide members defined, on one side surfaces thereof facing each other, with guide grooves which receive and guide both widthwise edges of paper, and formed, on respective rear, and front surfaces thereof, with flat geared portions;

left and right gear bands formed, on respective front and rear surfaces thereof, with rack gears which are respectively meshed with the flat geared portions of the left and right guide members;

a pinion gear positioned between the left and right gear bands and meshed with the rack gear of the left and right gear bands; and an adjustment knob slidably installed on a printer body and connected to one end of the right gear band.

2. The paper guide device as set forth in claim 1, wherein the left and right gear bands are made of synthetic resin having a predetermined flexibility.

3. The paper guide device as set forth in claim 1, wherein a pair of guide rails for guiding the left and right gear bands are secured to an inner surface of an upper wall of the printer body; a rotation shaft for rotatably supporting the pinion gear is secured to the inner surface of the upper wall of the printer body between the pair of guide rails; a pair of slots for allowing the left and right guide members to be moved therealong are defined through the upper wall of the printer body to extend in a widthwise direction of the printer body; and an adjustment slot for allowing the adjustment knob to be moved therealong is defined through the upper wall of the printer body to extend in a lengthwise direction of the printer body.

4. The paper guide device as set forth in claim 1, wherein a fitting hole is defined at the one end of the right gear band, and a projection which is fitted into the fitting hole is formed adjacent to a lower end of the adjustment knob.

* * * * *